US005806349A

United States Patent [19]

Kim et al.

[11] Patent Number: 5,806,349

[45] Date of Patent: Sep. 15, 1998

[54] WASHING MACHINE WITH BALL BALANCER

[75] Inventors: Do Weon Kim, Seoul; Sung Jae Shin, Suwon, both of Rep. of Korea

[73] Assignee: Samsung Electronics Co., Ltd., Suwon, Rep. of Korea

[21] Appl. No.: 864,348

[22] Filed: May 28, 1997

[30] Foreign Application Priority Data

Jun. 3, 1996 [KR] Rep. of Korea ..... 96-14763 U
Jun. 26, 1996 [KR] Rep. of Korea ..... 96-24173

[51] Int. Cl.[6] ..... D06F 37/24

[52] U.S. Cl. ..... 68/23.2; 74/573 F

[58] Field of Search ..... 68/23.2; 210/144, 210/363, 364; 74/573 F, 573 R

[56] References Cited

U.S. PATENT DOCUMENTS 4,433,592 2/1984 Tatsumi et al. ..... 68/23.2 X
5,605,078 2/1997 Taylor et al. ..... 74/573 F X

FOREIGN PATENT DOCUMENTS 137638 8/1983 Japan ..... 68/23.2
555309 7/1977 U.S.S.R. ..... 74/573 R

*Primary Examiner*—Philip R. Coe
*Attorney, Agent, or Firm*—Burns, Doane, Swecker & Mathis, L.L.P.

[57] ABSTRACT

A washing machine having a ball balancer is provided. The washing machine comprises: an external cabinet; an outer tub suspended inside the external cabinet; a rotary tub rotatably installed inside the outer tub for containing the laundry therein; and a ball balancer installed at a circumference of the rotary tub for balancing a rotation of the rotary tub. The ball balancer comprises: a casing installed at the circumference of the rotary tub and having at least one annual chamber formed therein; a multiplicity of balancing balls contained in the annual chamber of the casing; and a viscous fluid contained in the chamber of the casing. Here, the annual chamber of the casing is formed at the bottom of the annual chamber with at least one groove for receiving the balancing balls over a predetermind circumferencial length, and the groove has an inclined radial outer wall for guiding a upward movement of the balancing balls, as a rotational speed of the rotary tub increases. Accordingly, when the rotary tub rotates at a low speed, the increase of vibrations of the rotary tub is prevented.

9 Claims, 7 Drawing Sheets

WASHING MACHINE WITH BALL BALANCER

BACKGROUND OF THE INVENTION

The present invention relates to a washing machine including a rotary tub and a ball balancer installed at the rotary tub for balancing a rotation of the rotary tub.

Referring to FIG. 9 which shows a section of a conventional washing machine 101, the washing machine 101 includes an external cabinet 2, an outer tub 3 elastically suspended inside the external cabinet 2 and a rotary tub 4 rotatably installed inside the outer tub 3 to contain the laundry therein. A pulsator 5 is installed at the bottom of the rotary tub 4 to rotate washing water. The rotary tub 4 or the pulsator 5 is selectively rotated in a forward or reverse direction, by a power transmission unit 9 installed below the outer tub 3 and having a driving motor 7 and a shaft assembly 8.

During an operation of the washing machine 101, vibrations are generated due to a rotation of the rotary tub 4. The vibrations are severe especially when the load of the laundry in the rotary tub 4 is unbalanced. Therefore a balancer 111 is installed to the rotary tub 4 to balance a rotation of the rotary tub 4, thereby decreasing the vibrations.

A balancer generally includes an annular casing having an annular chamber formed therein. The balancer is classified into a solid balancer, a liquid balancer and a ball balancer, according to a material contained in the chamber of the casing. Such a balancer is disclosed in the U.S. Pat. No. 4,433,592 in detail.

Referring to FIG. 9, the conventional washing machine 101 has the ball balancer 111. The ball balancer 111 includes a multiplicity of balancing balls 115 and a viscous fluid 117, which are contained in an annular chamber 113. The balancing balls 115 and the viscous fluid 117 are movable along the annular chamber 113. At this time, the movement of the balancing balls 115 is limited by the viscosity of the viscous fluid 117, so that collision between the balancing balls 115 during the rotation of the rotary tub 4 is prevented, thereby reducing noises.

The balancing balls 111 move inside the annular chamber 113 by the centrifugal force generated during the rotation of the rotary tub 4, and consequently are located opposite to the unbalanced load of the laundry within the rotary tub 4. Accordingly, the rotation of the rotary tub 4 can be balanced, thereby preventing the vibrations and noises.

However, in the ball balancer 111 for use in the conventional washing machine 101, the balancing balls 115 are irregularly arranged on the flat bottom of the chamber 103, regardlessly connected with a rotational speed of the rotary tub 4. The irregularly arranged balancing balls move toward the unbalanced load of the laundry, until the rotational speed of the rotary tub 4 reaches a predetermined value. Accordingly, when the rotary tub 4 rotates at a low speed, especially at an initial stage of a dehydrating operation, the movement of the balancing balls 115 toward the unbalanced load side increases a rotational unbalance of the rotary tub 4, thereby increasing the vibrations and noises.

SUMMARY OF THE INVENTION

It is an object of the present invention to provide a washing machine having a ball balancer which is capable of maintaining a rotational balance of a rotary tub when the rotary tub rotates at a low speed, especially at an initial stage of a dehydrating operation, to thereby decrease vibrations and noises.

To accomplish the above object, there is provided a washing machine comprising:

an external cabinet;

an outer tub suspended inside said external cabinet;

a rotary tub rotatably installed inside said outer tub for containing the laundry therein; and a ball balancer installed at a circumference of said rotary tub for balancing a rotation of said rotary tub;

wherein said ball balancer comprises: a casing installed at the circumference of said rotary tub and having at least one annular chamber formed therein; a multiplicity of balancing balls contained in said annular chamber of said casing; and a viscous fluid contained in said annular chamber of said casing, and wherein said annular chamber of said casing is formed at the bottom of said annular chamber with at least one groove for receiving said balancing balls over a predetermined circumferencial length, and said groove has an inclined radial outer wall for guiding a upward movement of said balancing balls, as a rotational speed of said rotary tub increases.

Here, it is preferable that the grooves are at regular circumferential intervals. And, proferbly, the grooves are transfered to the bottom of the chamber through circumferencial surfaces.

A plurality of the annular chambers are arranged vertically to form an upper chamber and a lower chamber. Here, the inclination angle of the inclined surface formed at the grooves of the upper chamber is greater than that of the inclined surface formed at the grooves of the lower chamber. And, the diameter of the balancing balls contained in the upper chamber is larger than that of the balancing balls contained in the lower chamber.

Alternatively, a plurality of the annular chambers are arranged horizontally to form an outer chamber and an inner chamber. Here, the inclination angle of the inclined surface formed at the grooves of the outer chamber is greater than that of the inclined surface formed at the grooves of the inner chamber. And, the diameter of the balancing balls contained in the outer chamber is larger than that of the balancing balls contained in the inner chamber.

BRIEF DESCRIPTION OF THE DRAWINGS

The above object and advantages of the present invention will become apparent by describing in detail preferred embodiments thereof with reference to the accompanying drawings in which.

DETAILED DESCRIPTION OF THE INVENTION

Figure 1:
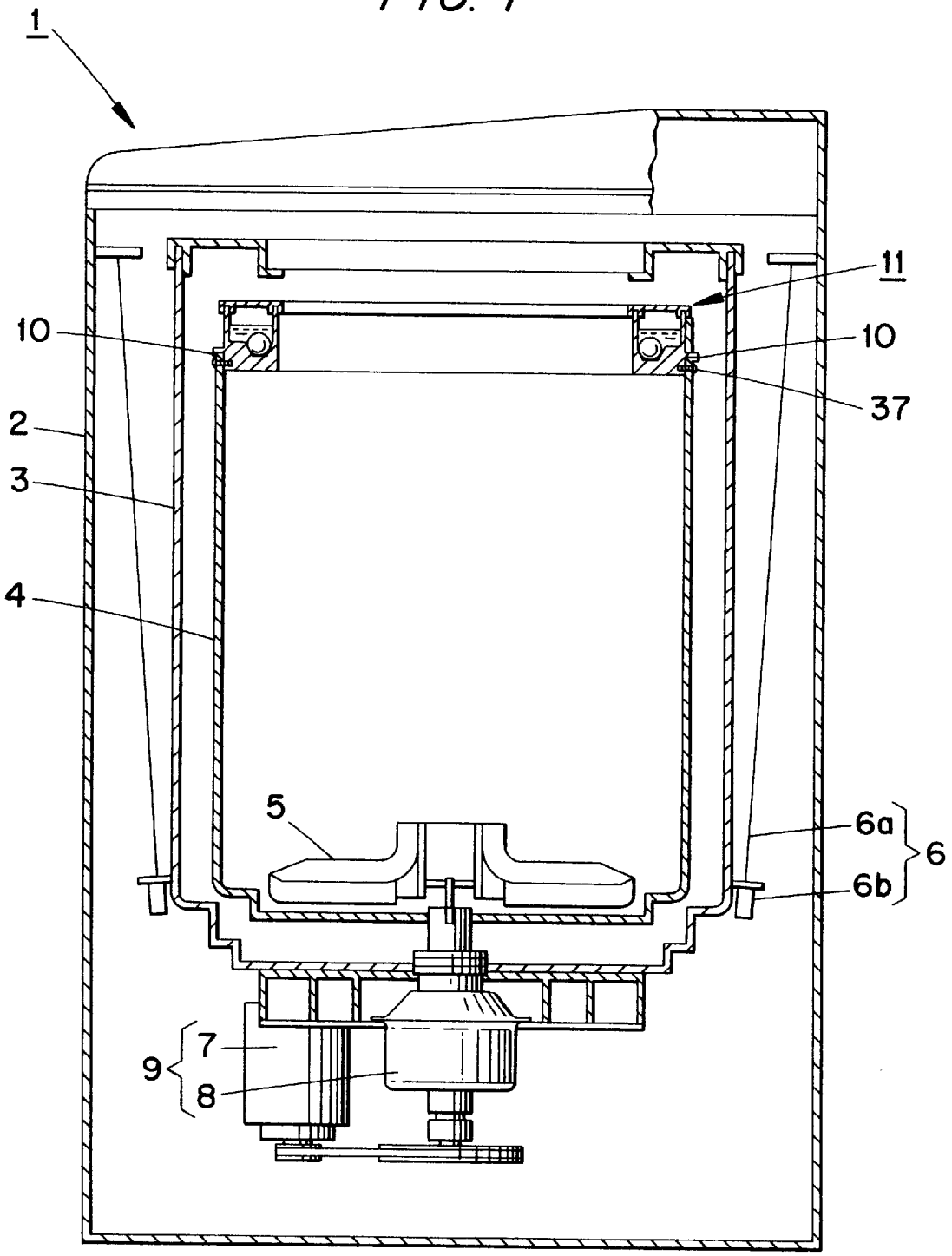
FIG. 1 shows a section of a washing machine having a ball balancer, according to a first embodiment of the present invention.

Referring to FIG. 1, a washing machine 1 having a ball balancer 11, according to a first embodiment of the present invention includes an external cabinet 2, an outer tub 3 suspended inside the external cabinet 2 by a suspension unit 6, and a rotary tub 4 rotatably installed inside the outer tub 3 to contain the laundry therein. The external cabinet 2 has an approximately rectangular cylinder shape, and the outer and rotary tubs 3 and 4 each have circular cylinder shapes. The wall of the rotary tub 4 is formed with a plurality of holes through which washing water communicates between the outer tub 3 and the rotary tub 4. A pulsator 5 is installed at the bottom of the rotary tub 4 to generate a spiral flow to the washing water.

The suspension unit 6 elastically suspends the outer tub 3 with respect to the external cabinet 2, to decrease vibrations of the outer tub 3. The suspension unit 6 includes a suspension bar 6*a* and a damper 6*b* mounted at the lower end of the suspension bar 6*a* and fixed to the outer tub 3. The damper 6*b* has a bell-shaped friction cover (not shown), a frictional member installed in the friction cover (not shown) and a spring (not shown). The frictional member is fixed to the end of the suspension bar 6*a* and frictionally slides inside the friction cover according to the vibrations of the outer tub 3. The vibrations are decreased by a frictional force between the friction cover and the frictional member.

A power transmission unit 9 having a driving motor 7 and a shaft assembly 8 is installed below the outer tub 3. The power transmission unit 9 is fixedly installed below the outer tub 3, while being surrounded by a saddle (not shown). The power transmission unit 9 functions to selectively rotate the rotary tub 4 or the pulsator 5 in a forward or reverse direction according to a program stored in a controller (not shown), so that washing, rinsing and dehydrating operations are sequentially performed.

A flange 10 is formed outwardly on the upper circumference of the rotary tub 4. The flange 10 contacts a supporting rib 33 (refer to FIG. 3) formed at an annular casing 12 the ball balancer 11 to support the ball balancer 11 upward.

Figure 2:
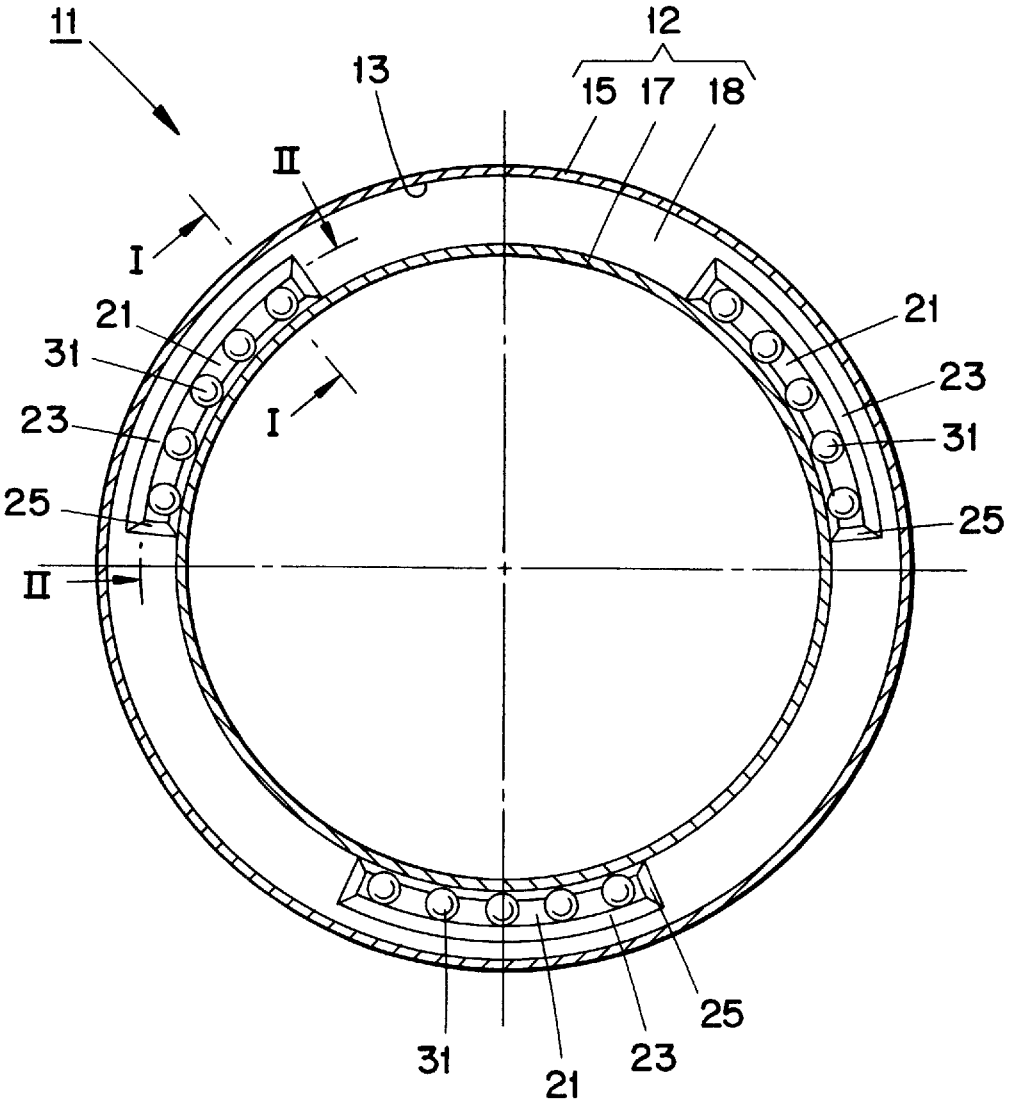
FIG. 2 shows a section of the ball balancer in FIG. 1.
Figure 3:
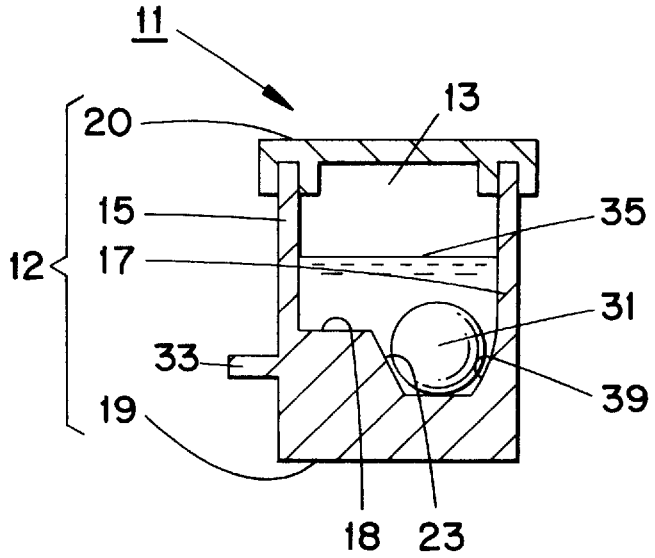
FIG. 3 shows an enlarged section of the ball balancer taken along line I—I in FIG. 2.
Figure 4:
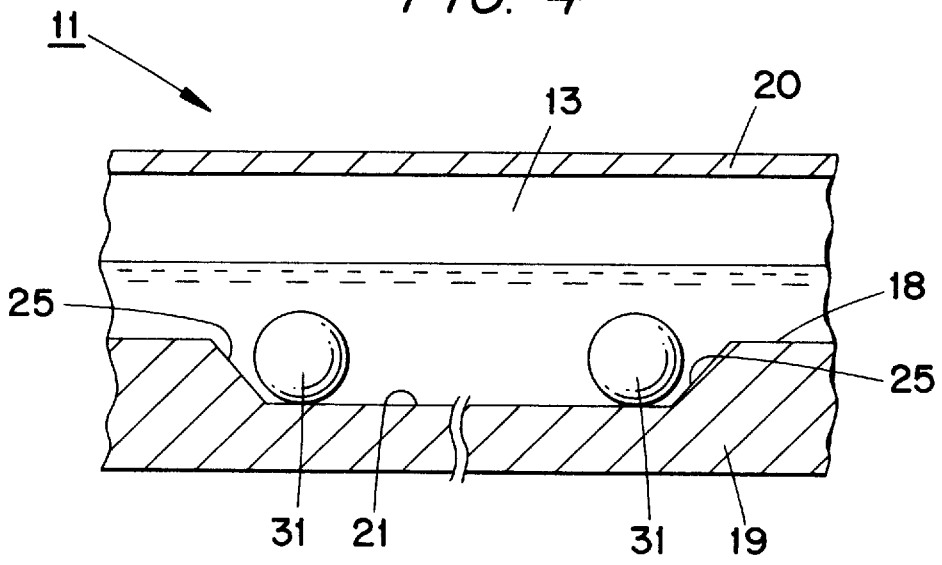
FIG. 4 shows an enlarged section of the ball balancer taken along line II—II in FIG. 2.

Referring to FIGS. 2, 3 and 4, the ball balancer 11 includes an annular casing 12 coaxially installed to the rotary tub 4 and having an annular chamber 13 formed therein. The casing 12 has an outer wall member 15, an inner wall member 17 and a bottom member 19 which are integrally formed, and a cover member 20 for covering a receiving space formed by the outer and inner wall members 15 and 17 and the bottom member 19, to form the chamber 13.

The supporting rib 33 is formed on a circumferential portion connecting the outer wall member 15 and the bottom member 19. The supporting rib 33 is seated on the flange 10 of the rotary tub 4 to support the ball balancer 11. The bottom member 19 of the ball balancer 11 and the upper portion of the rotary tub 4 are combined with each other by a fastening means such as a screw 37 (see FIG. 1).

Inside the chamber 13 of the casing 12, a multiplicity of balancing balls 31 and a viscous fluid 35 are contained. The balancing balls 31 which are preferably made of metal, for example, aluminum or steel, are immersed in the viscous fluid 35. The balancing balls 31 and the viscous fluid 35 can be easily inserted into the chamber 13 of the casing 12 with the cover member 20 of the casing 12 being opened. The balancing balls 31 and the viscous fluid 35 move along the chamber 13 inside the casing 12. The viscous fluid 35 has a predetermined viscosity so as to limit the movement of the balancing balls 31, thereby preventing collision between the balancing balls 31.

Referring to FIG. 2, a plurality of, preferably, three grooves 21 are formed on the upper surface 18 of the bottom member 19 at regular intervals. The balancing balls 31 are disposed in the grooves 21. Inclined surfaces 25 are formed at the opposite ends of the grooves 21 in a circumferencial direction of the ball balancer 11. Also, an inner inclined surface 39 (FIG. 3) and an outer inclined surface 23 are respectively formed at the radial inner wall and outer wall of the grooves 21 in a lengthwise direction thereof. The same number of the balancing balls 31 are contained in the respective grooves 21 to uniformly distribute the load of the balancing balls 31.

The balancing balls 31 can ascend along the outer inclined surface 39 formed at the grooves 21 by a centrifugal force generated during the rotation of the rotary tub 4.

In the washing machine having the above-structured ball balancer 11, when the rotary tub 4 rotates at a low speed, for example, at an initial stage of a dehydrating operation, the balancing balls 31 remain in the grooves 21. That is, the balancing balls 31 do not move toward the unbalanced load side of the laundry inside the rotary tub 4, thereby preventing the increase of the vibrations of the rotary tub 4, unlike the conventional washing machine.

When the rotational speed of the rotary tub 4 increases step by step, there are a centrifugal force of the balancing balls worked gradually. And, as the rotational speed of the rotary tub reaches a predetermined value, the balancing balls 31 ascend along the inclined surfaces 23 and 25 from the bottom of the grooves onto the upper surface 18 of the bottom member 19 by the centrifugal force. At this time, the balancing balls 31 located on the upper surface 18 of the bottom member 19 move opposite to the unbalanced load side of the laundry along the annular chamber 13, so as to balance a rotation of the rotary tub 4.

As described above, when the rotary tub 4 rotates at a low speed, vibrations and noises can be decreased, compared with the conventional washing machine because the balancing ball are disposed in the grooves forming equidistantly along the annular chamber 13.

Meanwhile, as the rotational speed of the rotary tub 4 decreases, the rotational speeds of the balancing balls 31 and the rotary tub 4 become different from each other, so that a part of the balancing balls 31 directly return into the grooves 21. The remaining part of the balancing balls 31 move slightly on the upper surface 18 of the bottom member 19 by vibrations of the rotary tub 4 generated during a washing or rinsing operation, and consequently returns into the grooves 21. The inclined surfaces 23 and 25 facilitate the returning of the balancing balls 31 to the grooves 21.

Figure 5:
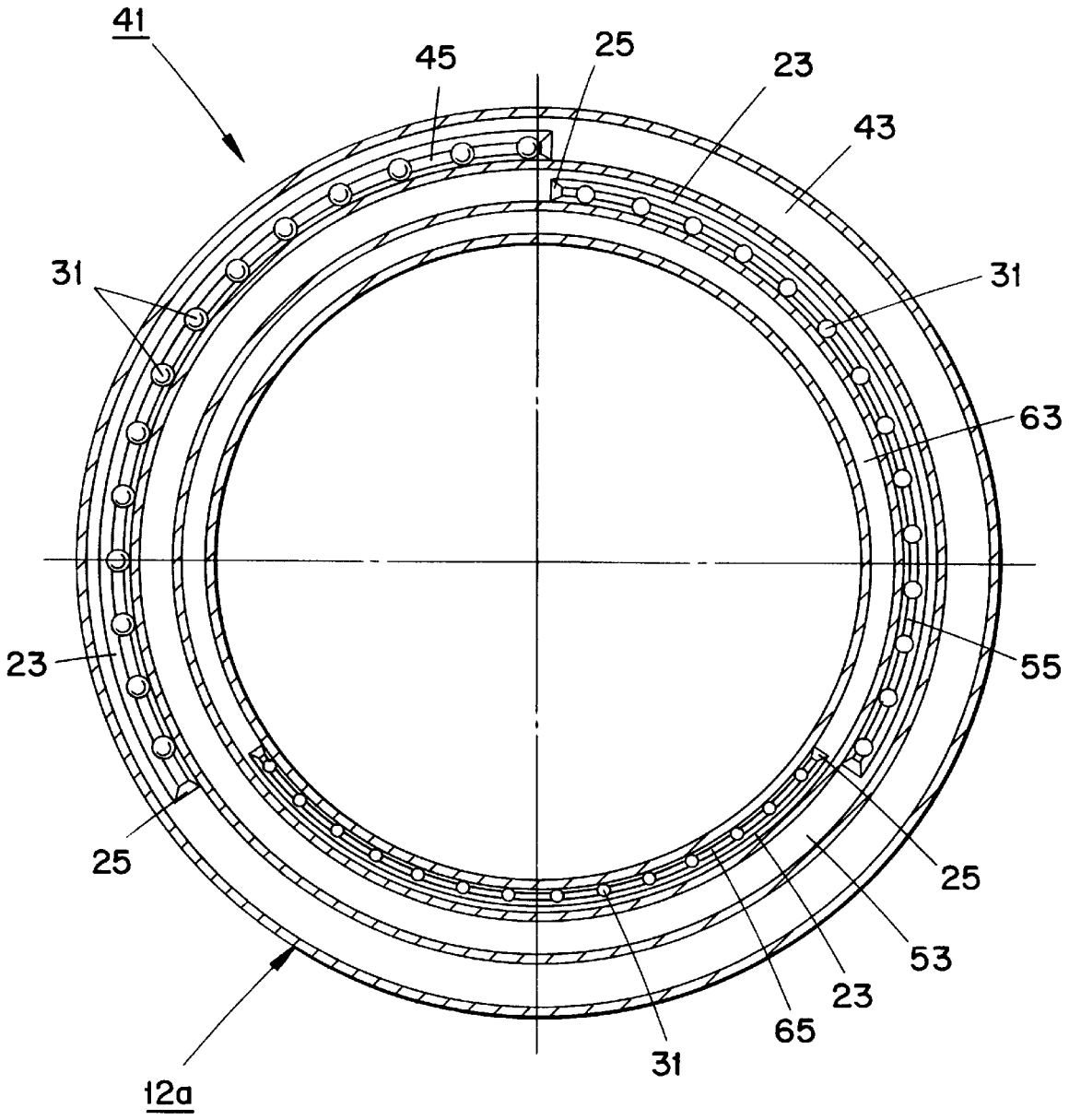
FIG. 5 shows a section of a ball balancer for use in a washing machine according to a second embodiment of the present invention.

Referring to FIG. 5, a ball balancer 41 for use in a washing machine according to a second embodiment of the present invention includes a casing 12*a*formed with a plurality of, preferably, three annular chambers 43, 53 and 63 which are concentrically and horizontally arranged. The chambers 43, 53 and 63 are formed with grooves 45, 55, and 65 at the bottoms thereof, respectively. The grooves 45, 55 and 65 are arranged at regular intervals, that is, 120°, without overlapping. The shape of the grooves 45, 55 and 65 is the same as the grooves 21 described with reference to FIGS. 1 to 3, and therefore a detailed description thereof will be omitted.

The width of the outer groove 65 is larger than that of the central groove 55, and the width of the central groove 55 is larger than that of the inner groove 45. The diameters of the balancing balls 31 arranged in the respective grooves 45, 55 and 65 are also proportional to the widths of the grooves 45, 55 and 65.

In the washing machine having the above-structured ball balancer 41, when the rotary tub 4 rotates at a low speed, the balancing balls 31 remain in the grooves 45, 55 and 65, thereby preventing the increase of the vibrations of the rotary tub 4. As the rotational speed of the rotary tub 4 increases, the balancing balls 31 move out of the grooves 45, 55 and 65 and opposite to the unbalanced load side of the laundry inside of the rotary tub 4, to thereby balance the rotation of the rotary tub 4.

Although the grooves 45, 55 and 65 are preferably neither overlapped nor separated in their lengthwise direction in the present embodiment, the lengths thereof may be adjusted, that is, shortened or lengthened as necessary. Also, each of the grooves 45, 55 and 65 may be formed to a paired structure. In this case, it is preferable that each pair of grooves are arranged opposite to each other.

The outer inclined surfaces 23 of the respective grooves 45, 55 and 65 may be formed differently from one another, in their inclination angles. In this case, it is preferable that the inclination angles of the inclined surfaces 23 increase according as the inclined surfaces 23 are located outward. Accordingly, as the rotational speed of the rotary tub 4 increases, the balancing balls 31 sequentially move out of the grooves 45, 55 and 65, that is, first out of the inner groove 45, then out of the central groove 55 and last out of the outer groove 65. According to this modified embodiment, a variety of vibration damping effects can be achieved according to the rotational speed of the rotary tub 4.

Further, the diameters of the balancing balls 31 may be gradually increased outward so as to perform the same function. That is, since the moments of inertia of the balancing balls 31, which resist the centrifugal forces applied thereto, are proportional to the fifth power of the diameters thereof, when the centrifugal forces are applied to the balancing balls 31 by the rotation of the rotary tub 4, the balancing balls 31 in the inner groove 65 ascend first, and the balancing balls 31 in the outer groove 45 ascend last. Accordingly, various vibration damping effects can be achieved according to the rotational speed of the rotary tub 4.

Figure 6:
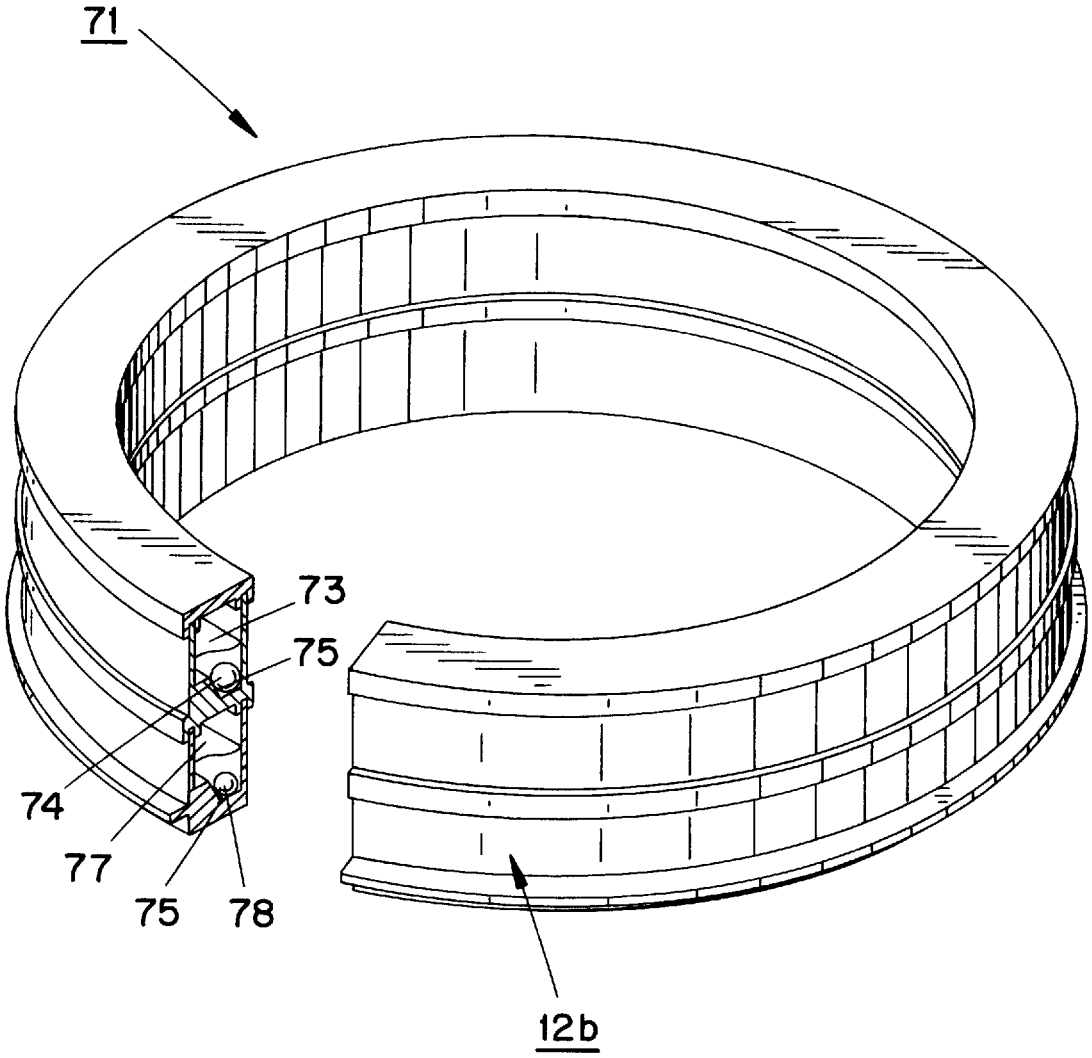
FIG. 6 shows a particially cut-out perspective view of a ball balancer for use in a washing machine according to a third embodiment of the present invention.

Referring to FIG. 6, a ball balancer 71 for use in a washing machine according to a third embodiment of the present invention includes a multi-layer casing 12*b* having upper and lower chambers 73 and 77 which are vertically arranged and have grooves 75, respectively. A multiplicity of upper and lower balancing balls 74 and 78 are contained in the upper and lower chambers 73 and 77, respectively. As in the first and second embodiments, when the rotary tub 4 rotates at a low speed, the balancing balls 74 and 78 remain in the grooves 75, thereby preventing the increase of the vibrations of the rotary tub 4.

In this structure, when the rotary tub 4 rotates, the radius of gyration of the upper chamber 73 is larger than that of the lower chamber 77. Accordingly, as the rotational speed of the rotary tub 4 increases, the upper balancing balls 74 move out of the upper groove 75 first, and then the lower balancing balls 78 move out of the lower groove 75, so that the rotation of the rotary tub 4 can be effectively balanced according to the rotational speed thereof.

In the third embodiment, the diameters of the upper and lower balancing balls 74 and 78 may be different from each other as necessary. Also, the inclination angles of the inclined surfaces of the upper and lower grooves 75 may be different from each other.

Figure 7:
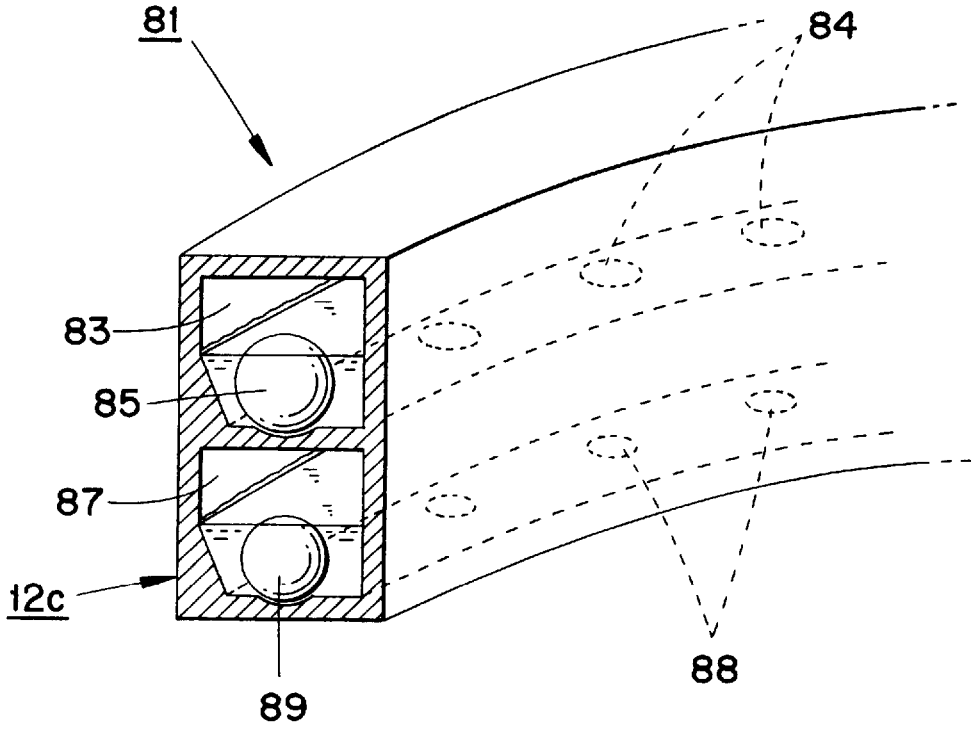
FIG. 7 shows a partial perspective view of a ball balancer for use in a washing machine according to a fourth embodiment of the present invention.

Referring to FIG. 7, a ball balancer 81 for use in a washing machine according to a fourth embodiment of the present invention includes a multi-layer casing 12*c* having upper and lower chambers 83 and 87 which are vertically arranged. A multiplicity of upper and lower balancing balls 85 and 89 are contained in the upper and lower chambers 83 and 87, respectively. A multiplicity of upper and lower grooves 84 and 88 are formed at the bottoms of the upper and lower chambers 83 and 87, respectively, to correspond to the upper and lower balancing balls 85 and 87, so that each of the balancing balls 85 and 89 is seated in each of the grooves 84 and 88. It is preferable that the grooves 84 and 88 are spaced from each other at regular intervals. It is also preferable that when the diameters of the upper and lower balancing balls 85 and 89 are different from each other, the sizes of the upper and lower grooves 84 and 88 are different from each other, to correspond to the diameters of the upper and lower balancing balls 85 and 89. As in the previous embodiments, when the rotary tub 4 rotates at a low speed, the upper and lower balancing balls 85 and 87 remain in the upper and lower grooves 84 and 88, respectively, thereby preventing the increase of the vibrations of the rotary tub 4. As the rotational speed of the rotary tub 4 increases and reaches predetermined value, the upper and lower balancing balls 85 and 89 sequentially move out of the upper and lower grooves 84 and 88, respectively, thereby balancing the rotation of the rotary tub 4 according to the rotational speed of the rotary tub 4.

Figure 8:
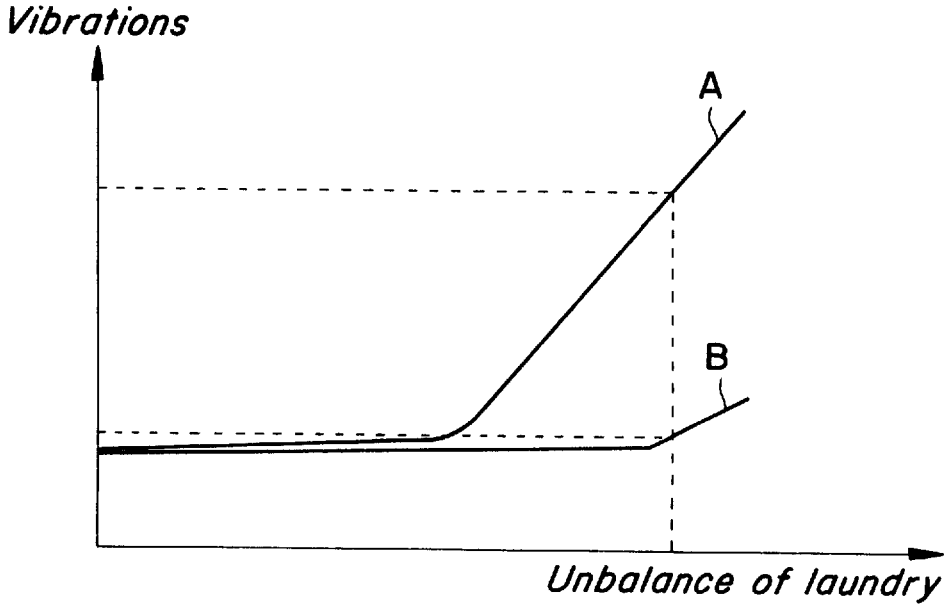
FIG. 8 is a graph showing vibrations in the washing machine according to the fourth embodiment of the present invention, in contrast to a conventional washing machine.
Figure 9:
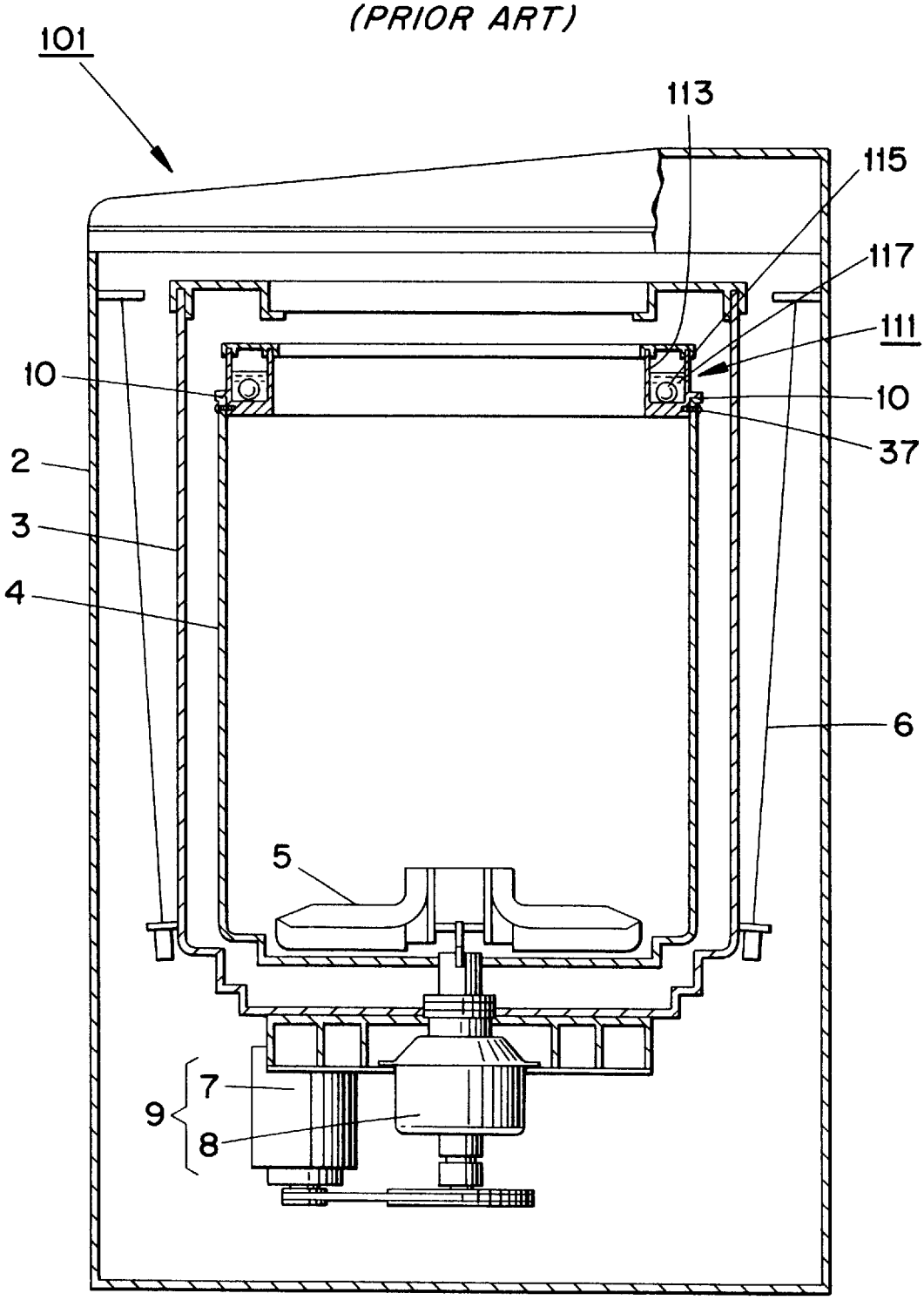
FIG. 9 (PRIOR ART)
FIG. 9 shows a section of the conventional washing machine.

Referring to FIG. 8 which shows vibrations in the conventional washing machine and the washing machine according to the fourth embodiment of the present invention, it can be seen that the vibrations (curve B) in the washing machine according to the present embodiment are remarkably decreased as compared with the vibrations (curve A) of the conventional washing machine. Here, the curves A and B indicate vibrations measured at the initial stage of the dehydrating operation, respectively.

In the present embodiment, the diameters of the upper and lower balancing balls 85 and 89 may be different from each other, and the inclination angles of the upper and lower grooves 84 and 88 may be different from each other, as in the second and third embodiments.

As described above, according to the present invention, a groove is formed at the bottom of a chamber of a casing in which balancing balls are contained, so that the balancing balls remain in the groove when a rotary tub rotates at a low speed, for example, at an initial stage of a dehydrating operation, thereby preventing increase of vibrations of the rotary tub. Further, when the casing is formed with a plurality of chambers which are arranged vertically or horizontally, a variety of vibration damping effects can be obtained according to rotational speed of the rotary tub.

What is claimed is:

1. A washing machine comprising:

an external cabinet;

an outer tub suspended inside said external cabinet;

a rotary tub rotatably installed inside said outer tub for containing the laundry therein; and a ball balancer installed at a circumference of said rotary tub for balancing a rotation of said rotary tub, wherein said ball balancer comprises: a casing installed at the circumference of said rotary tub and having at least one annular chamber formed therein; a multiplicity of balancing balls contained in said annular chamber of said casing; and a viscous fluid contained in said annular chamber of said casing, and wherein said annular chamber of said casing is formed at the bottom of said annular chamber with at least one groove for receiving said balancing balls over a predetermined circumferencial length, and said groove has an inclined radial outer wall for guiding a upward movement of said balancing balls, as a rotational speed of said rotary tub increases.

2. A washing machine as claimed in claim 1, wherein a plurality of said grooves are spaced at regular circumferential intervals.

3. A washing machine as claimed in claim 1, wherein said grooves are transfered to said bottom of said chamber through circumferencial surfaces.

4. A washing machine as claimed in claim 1, wherein a plurality of said annular chambers are arranged vertically to form an upper chamber and a lower chamber.

5. A washing machine as claimed in claim 4, wherein the inclination angle of said inclined surface formed at said grooves of said upper chamber is greater than that of said inclined surface formed at said grooves of said lower chamber.

6. A washing machine as claimed in claim 5, wherein the diameter of said balancing balls contained in said upper chamber is larger than that of said balancing balls contained in said lower chamber.

7. A washing machine as claimed in claim 1, wherein a plurality of said annular chambers are arranged horizontally to form an outer chamber and an inner chamber.

8. A washing machine as claimed in claim 7, wherein the inclination angle of said inclined surface formed at said grooves of said outer chamber is greater than that of said inclined surface formed at said grooves of said inner chamber.

9. A washing machine as claimed in claim 8, wherein the diameter of said balancing balls contained in said outer chamber is larger than that of said balancing balls contained in said inner chamber.

* * * * *